US005592044A

United States Patent [19]

Ohtake et al.

[11] Patent Number: 5,592,044

[45] Date of Patent: Jan. 7, 1997

[54] COLOR CATHODE RAY TUBE AND METHOD OF MANUFACTURING SHADOW MASK

[75] Inventors: Yasuhisa Ohtake; Seiji Sago; Mitsuaki Yamazaki, all of Fukaya; Sachiko Muramatsu, Tatebayashi, all of Japan

[73] Assignee: Kabushiki Kaisha Toshiba, Kawasaki, Japan

[21] Appl. No.: 451,814

[22] Filed: May 26, 1995

[30] Foreign Application Priority Data

May 27, 1994 [JP] Japan ..... 6-113232

[51] Int. Cl.[6] ..... H01J 29/07

[52] U.S. Cl. ..... 313/403; 313/402

[58] Field of Search ..... 313/402, 403, 313/404, 405, 406, 407, 408; 445/97

[56] References Cited

U.S. PATENT DOCUMENTS

| | | | |
|---|---|---|---|
| 3,787,939 | 1/1974 | Tomita et al. | 313/402 |
| 4,168,450 | 9/1979 | Yamauchi et al. | 313/403 |
| 4,662,984 | 5/1987 | Ohtake et al. | 313/403 |
| 4,734,615 | 3/1988 | Koike et al. | 313/403 |
| 4,771,213 | 9/1988 | Higashinakagawa et al. | 313/402 |
| 4,864,188 | 9/1989 | Sugai et al. | 313/402 |

FOREIGN PATENT DOCUMENTS

| | | |
|---|---|---|
| 0487106 | 11/1991 | European Pat. Off. . |
| 2166107 | 8/1973 | France . |
| 47-7670 | 3/1972 | Japan . |
| 55-2697 | 1/1980 | Japan . |
| 59-16249 | 1/1984 | Japan . |
| 2020892 | 11/1979 | United Kingdom . |

*Primary Examiner*—Sandra L. O'Shea
*Assistant Examiner*—Vip Patel
*Attorney, Agent, or Firm*—Cushman Darby & Cushman IP Group of Pillsbury Madison & Sutro LLP

[57] ABSTRACT

A color cathode ray tube has a face panel, a phosphor screen formed on an inner surface of the face panel, an electron gun for emitting electron beams toward the phosphor screen, and a shadow mask arranged between the electron gun and the face panel to oppose the phosphor screen. The shadow mask has a large number of electron beam apertures through which the electron beams pass. Each of the electron beam apertures has a small opening open to a first surface of the shadow mask and a large opening open to a second surface of the shadow mask and communicating with the small opening. The large opening has a center axis and a diameter larger than that of the small opening. A wall surface of the shadow mask which defines the large opening of each of the electron beam apertures located at a peripheral portion of the shadow mask includes a bulged portion. The bulged portion is located on the opposite side of a mask center with respect to the center axis of the large opening, and is bulged outward in the radial direction.

5 Claims, 6 Drawing Sheets

COLOR CATHODE RAY TUBE AND METHOD OF MANUFACTURING SHADOW MASK

BACKGROUND OF THE INVENTION

1. Field of the Invention

The present invention relates to a color cathode ray tube and a method of manufacturing a shadow mask used in the color cathode ray tube.

2. Description of the Related Art

A shadow mask type color cathode ray tube comprises a glass envelope having a face panel, a funnel and a neck; a phosphor screen on which a plurality of phosphor dots or stripes are regularly arranged and which is formed on an inner surface of the face panel; and an electron gun disposed in the neck portion of the envelope to emit plural electron beams to the phosphor screen. Further, a shadow mask having a large number of regularly arranged electron beam apertures is disposed in the envelope, more closely opposing to the phosphor screen between the phosphor screen and the electron gun.

The shadow mask based on the principle of parallax is one of significant components which has a function of allowing plural electron beams shot from the electron gun to pass therethrough to correctly land on their geometrically corresponding phosphor dots or stripes, and it is called a color selection electrode.

Each electron beam coming to the peripheral portion of the shadow mask has a certain angle relative to the tube axis of the cathode ray tube. Each electron beam aperture, therefore, has such a specific shape that allows the electron beam to easily pass therethrough. In short, each electron beam aperture of the shadow mask has a larger sectional area on the phosphor screen side of the shadow mask, as compared with that on the electron gun side thereof. Usually, this part of the aperture which is on the phosphor screen side is called as a large opening and that part thereof which is on the electron gun side is called as a small opening to distinguish them from the other in sectional area.

The shadow masks are generally grouped to those having circular electron beam apertures and those having rectangular ones. The former are usually used in display tubes that display characters and figures while the latter in home-used tubes such as television tubes.

Recently, the display tubes are more often used as display units in personal and office computers or in various kinds of OA terminal equipment. Therefore, an image whose resolution is enhanced to a greater extent and which less reflects external light and has less distortion is demanded from the viewpoint of human technology. In order to meet these demands, the color cathode ray tube having a flatter face panel has been provided.

When the face panel is made flatter, the shadow mask which is same in shape as the face panel must also be made flatter and have a larger radius of curvature. In the flattened shadow mask, however, the angle of the electron beam which enters into its corresponding electron beam aperture becomes larger relative to the normal of the mask, as compared with that in the conventional shadow mask having a small radius of curvature. Needless to say, the angle of incidence of the electron beam becomes larger at the peripheral portion of the mask than at the center portion thereof, and part of the electron beam incident on the peripheral portion, therefore, collides against the aperture edge or aperture wall at a higher rate. When the electron beam collides against the aperture edge or aperture wall, the shape of the electron beam spot formed on the phosphor screen is distorted or so-called beam omissions are caused, thereby degrading the luminance or the uniformity of color purity. In addition, the contrast is also degraded because unintended phosphor dots are made luminous by electron beams reflected by the aperture edges and aperture walls.

The problem of beam spot distortion is more liable to be caused as the pitch of the electron beam apertures in the shadow mask becomes smaller and the shadow mask is made becomes thicker. In addition, it is more remarkable as the angle of incidence of the electron beam relative to the electron beam aperture becomes larger, as seen in the shadow mask which is made flatter and which has a larger radius of curvature. The quality of the color cathode ray tube is thus degraded.

Further, when the curvature radius of the shadow mask becomes larger, the tension strength of the mask is lowered to a greater extent, as compared with that of the conventional shadow mask whose curvature radius is small. The shadow mask, therefore, is more easily deformed by impacts added when the color cathode ray tube is being manufactured, transported and incorporated into the television set. That part of the shadow mask which is thus deformed cannot have a predetermined distance relative to the phosphor screen. Color shift is thus more easily caused and the quality reliability of the color cathode ray tube cannot be guaranteed. When the shadow mask is too excessively deformed, it has a complete partial color shift and it must be regarded as a defect one.

As means for preventing the beam spot distortion or beam omissions, it is imagined that the large opening of the electron beam aperture which opens on the phosphor screen side face of the shadow mask has a larger dimension. In this case, however, the large opening of the aperture must be etched larger in amount when it is formed in the shadow mask. The mechanical strength of the shadow mask is thus lowered, thereby reducing the tension strength thereof to a greater extent and causing the mask to be more easily deformed after it is press-formed.

In the shadow mask in which the electron beam apertures are regularly arranged at a small pitch to attain a high resolution, however, it is difficult that the wall of each aperture is so tilted as to enable the electron beam to completely pass therethrough even when the dimension of the large opening of each aperture is made so large that large openings of the adjacent electron beam apertures can be contacted with each other at their rims or edges on the surface of the shadow mask.

In order to solve this problems, Jpn. Pat. Appln. KOKOKU Publication No. Sho 47-7670 has proposed a so-called off-center mask in which the aperture center of the large opening of the electron beam aperture in the shadow mask is deviated from the aperture center of the small opening of the aperture in a direction in which the electron beam passes. This method of deviating the center axis of the large opening of the aperture from that of the small opening thereof to an extent needed is efficient for preventing a beam omission from being caused when the incident electron beam collides against the wall surface or edge of the large opening of the aperture. It is also efficient for preventing the mechanical strength of the mask from being reduced because the dimension of the large opening of the aperture can be kept small.

In the off-center mask, however, it is needed that the extent to which the center axis of the large opening of the aperture is deviated from that of the small opening thereof is made large to prevent the beam omission. When the electron beam aperture is viewed in the thickness direction of the shadow mask, therefore, its physical diameter becomes different in dimension from that of the beam spot formed on the phosphor screen by the electron beam which has actually passed through it. Further, the shape of the electron beam aperture formed at a boundary between the large and small openings of the aperture is not circular but deformed, and it is not stable accordingly. In the color cathode ray tube which is small in freedom of the electron beam landing area on the phosphor screen, therefore, degradation in the uniformity of color purity is more liable to be caused.

In order to make the off-center amount between the large and small openings of the aperture small and to tilt the wall surface of the large opening thereof to an extent needed, therefore, the dimension of the large opening must be made large to a limit although this limit depends upon the pitch of the apertures. In the shadow mask flattened and having a large radius of curvature, its tension strength becomes low after it is press-formed. As the dimension of the large opening of the aperture is set larger and larger, however, its mechanical strength becomes lower. This causes the shadow mask to be more often deformed.

When the thickness of the shadow mask is made large to increase its mechanical strength, it becomes difficult to control the etching by which each electron beam aperture is formed in it. Its quality is thus degraded. When it is made thick, the tilt of the wall surface defining the large opening of the aperture needed is also increased. The off-center amount must be therefore made large, thereby causing same problem.

As means for preventing beam omissions, it is imagined that the length from the boundary between the large and small openings of each electron beam aperture to that surface of the shadow mask which is on the side of the electron gun is made long and that the tilt of the wall of the large opening of each electron beam aperture needed is made small. In this case, however, the amount of the electron beam colliding against the wall surface of the small opening of the aperture is increased and the contrast is lowered by the electron beam reflected by this wall surface.

SUMMARY OF THE INVENTION

The present invention is therefore intended to eliminate the above-mentioned drawbacks, and its object is to provide a color cathode ray tube which is provided with a flatter shadow mask having a larger radius of curvature but capable of more effectively preventing electron beam omissions and also having a mechanical strength more enough to prevent deformation, and its object is also to provide a method of manufacturing the shadow mask.

In order to achieve the above object, a color cathode ray tube according to the present invention comprises a face panel having a phosphor screen formed on the inner face thereof; an electron gun arranged to oppose the phosphor screen to emit plural electron beams toward the phosphor screen; and a shadow mask arranged between the face panel and the electron gun to oppose the phosphor screen and having a large number of electron beam apertures which are regularly arranged almost all over the shadow mask and through which the electron beams pass. The shadow mask has a first surface opposed to the electron gun, a second surface opposed to the phosphor screen, and a mask center aligned with a tube axis of the cathode ray tube.

Each of the electron beam aperture has a small opening open to the first surface of the shadow mask and a large opening having a diameter larger than that of the small opening, open to the second surface thereof, and communicating with the small opening. A wall surface of the shadow mask which defines the large opening of each of the electron beam apertures located at the peripheral portion of the shadow mask includes a bulged portion which is located outward when viewed from the mask center of the shadow mask in a radial direction and which is bulged in the radial direction.

According to the above-described color cathode ray tube, electron beams shot from the electron gun enter into the peripheral portion of the shadow mask at a larger angle, as compared with those entering into the center portion thereof. In this case, the bulged portion is formed in that portion of the wall surface defining the large opening of each aperture along which the electron beam passes through the large opening, that is, which is located outward in the radial direction with respect to the mask center. Therefore, the electron beam can enter the phosphor screen, passing through the large opening and its bulged portion without colliding against the wall surface which defines the large opening of the aperture. This prevents the omission of the electron beam from being caused.

It is only needed in this case that the bulged portion is formed at least in that portion of the large opening defining wall surface which is located outward in the radial direction. As compared with a case where the diameter of the large opening of the aperture is made larger, therefore, the volume of the shadow mask can be less reduced and the mechanical strength thereof can be kept higher accordingly.

According to the present invention, a method of manufacturing the shadow mask comprises the steps of: exposing a resist film formed on a second surface of a mask material by a printing pattern which has a first pattern including a large number of opaque dot patterns provided to correspond to positions where large openings are to be formed, and a second pattern including independent sub-patterns each of which is provided, with a predetermined gap, on an outside of each of the dot patterns which are located at least at a peripheral portion of the mask material; removing that portion of the exposed resist film which is left not exposed; and etching the second surface of the mask material through the exposed resist film, from which the not-exposed portion has been removed, to form a large number of large openings corresponding to the first pattern and to form bulged portions which are bulged from corresponding large openings and correspond to the second pattern.

According to the above-described method, the large opening of each of the electron beam apertures is formed by etching the mask material through the first pattern which includes circular dot patterns each having such a size that causes no beam omission, and also through the second pattern which includes the independent sub-pattern located outside that portion of each dot patterns of the first pattern along which the electron beam passes. In short, the circular large openings of the electron beam apertures are formed by etching through the first pattern while their bulged portions by etching through the second pattern.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 through 4B show a color cathode ray tube according to an embodiment of the present invention, in which:

FIG. 1 is a longitudinal sectional view of the color cathode ray tube,

FIG. 2 is a front view of the color cathode ray tube,

FIG. 4B is a sectional view taken along a line IV—IV in FIG.

FIGS. 5A through 7E show a method of manufacturing the shadow mask, in which:

FIG. 5A is a plan view showing a resist film for small openings,

FIGS. 7A through 7E are sectional views respectively showing etching processes of the shadow mask described above;

FIGS. 8 and 9 show a shadow mask in the color cathode ray tube according to another embodiment of the present invention, in which:

FIG. 8 is a sectional view showing a part of the shadow mask, and

FIG. 9 is a plan view showing some of electron beam apertures in the shadow mask; and FIGS. 10 through 11B show a resist film used in a method of manufacturing the shadow mask according to the another embodiment of the present invention, in which:

FIG. 10 is a plan view of a resist film for large openings,

FIG. 11B is an enlarged plan view showing a large opening pattern having a divided ring-shaped sub-pattern.

DETAILED DESCRIPTION OF THE PREFERRED EMBODIMENTS

Some embodiments of the present invention will be described in detail with reference to the accompanying drawings.

Figure 1:
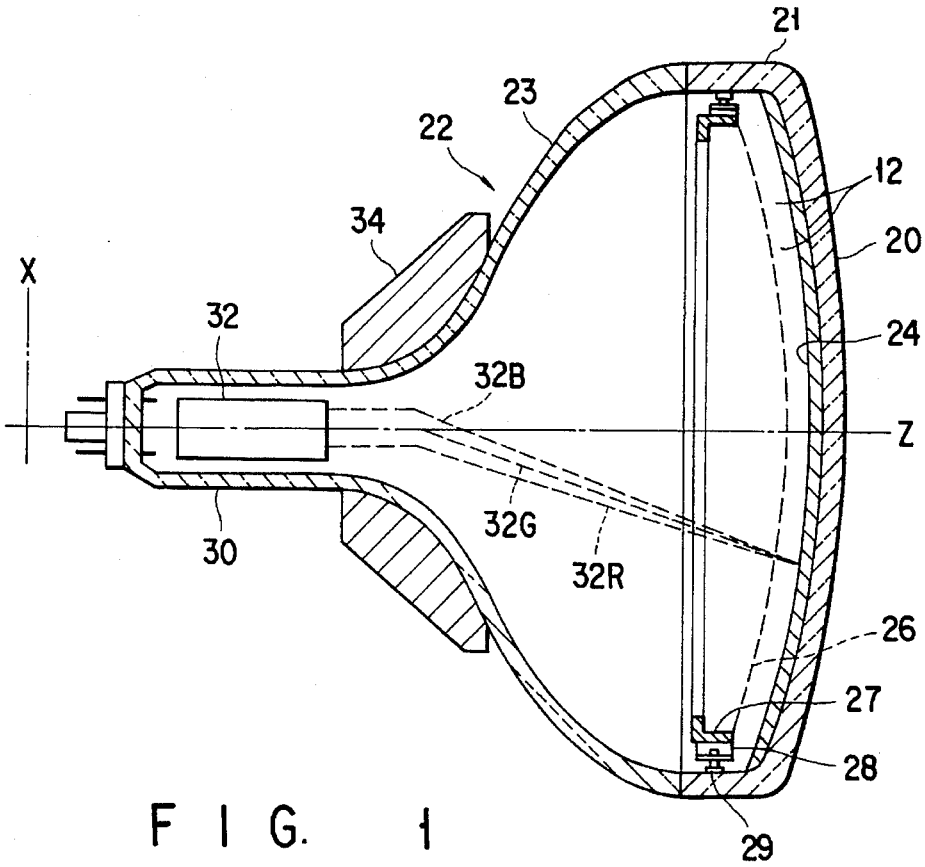

As shown in FIG. 1, the color cathode ray tube according to an embodiment of the present invention has a glass envelope 22, which is constituted by a substantially rectangular face panel 20, a skirt portion 21 continuous with the face panel 20, and a funnel 23 integrally bonded to the skirt portion 21. A phosphor screen 24, on which phosphor dots that emit light in red, blue and green are regularly arranged, is formed on the inner surface of the face panel 20. An electron gun 32 for emitting three electron beams 32R, 32G and 32B corresponding to red, blue and green is disposed in a neck 30 of the funnel 23. It is arranged on a tube axis Z of the cathode ray tube.

Figure 2:
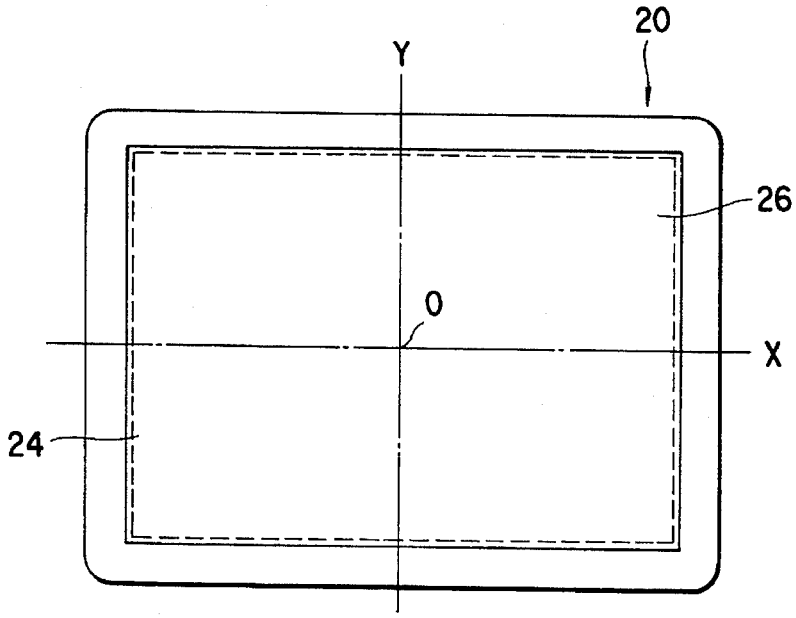

A substantially rectangular shadow mask 26 having a large number of regularly arranged electron beam apertures 12 is arranged in the envelope 22 and closely opposes the phosphor screen 24 at a predetermined distance. The peripheral edge portion of the shadow mask 26 is fixed to a mask frame 27, and a mask holder 28 provided on the mask frame 27 is fitted on stud pins 29 which are fixed to the skirt portion 21, so that the shadow mask 26 is installed inside the face panel 20. As shown in FIG. 2, the phosphor screen 24 has a 10 rectangular shape, when viewed from the front, and has a center O through which the tube axis Z extends, and a vertical axis Y and a horizontal axis X both extending through the center. The shadow mask 26 also has a mask center through which the tube axis Z extends.

The three electron beams 32R, 32G and 32B emitted from the electron gun 32 are deflected by a magnetic field generated by a deflection yoke 34 which is mounted on the outer surface of the funnel 23. The deflected electron beams are subjected to selection by the shadow mask 26 and scan the phosphor screen 24 in the horizontal and vertical directions, thereby displaying a color image on the face panel 20.

As shown in FIGS. 3A, 3B, 4A and 4B, the shadow mask 26 is formed of a thin metal plate. The circular electron beam apertures 12 are regularly formed in the metal thin plate at a predetermined opening pitch. Each electron beam aperture 12 has a small opening 40 open to surface **26*a* of the shadow mask 26 on the side of the electron gun 32, and a large opening 42 open to a surface 26*b* of the shadow mask 26 on the side of the phosphor screen 24 and communicating with the small opening 40. The small opening 40 is constituted by a substantially arcuated recess having a circular open edge. Similarly, the large opening 42 is constituted by a substantially arcuated recess having a circular open edge which has a diameter lager than that of the circular open edge of the small opening 40. The small and large openings 40 and 42 communicate with each other at the bottom portions of these recesses. A minimum-diameter portion of the electron beam aperture 12 that determines the aperture diameter of the electron beam aperture 12 is defined by the boundary 43 between the small and large openings 40 and 42**.

Figure 3A:
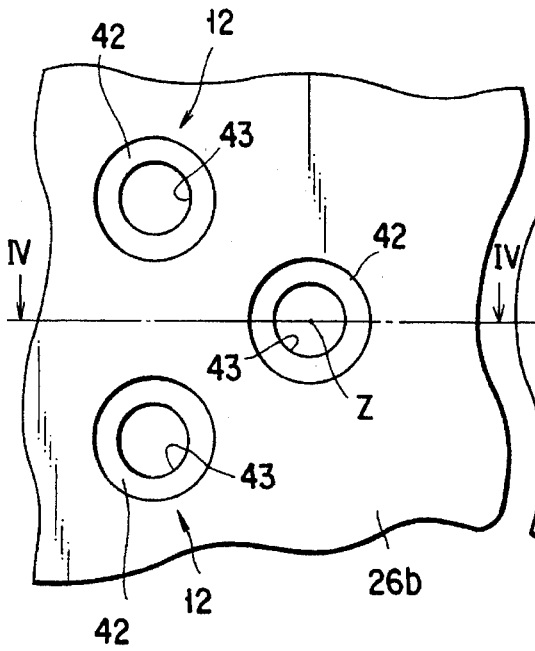
FIG. 3A is a plan view schematically showing the center portion of a shadow mask enlarged.
Figure 4A:
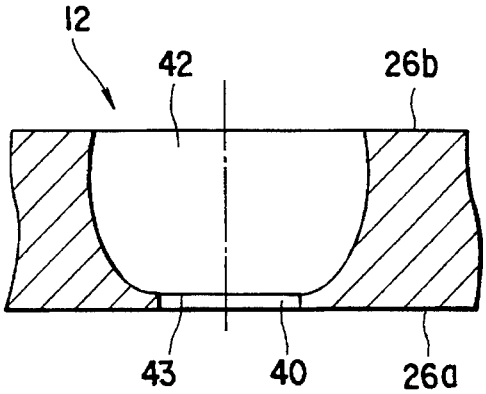
FIG. 4A is a sectional view taken along a line IV—IV in FIG. 3A.

As shown in FIGS. 3A and 4A, in the central portion of the shadow mask 26 including the tube axis Z, the small and large openings 40 and 42 of each electron beam aperture 12 are formed coaxially with each other, since electron beams emitted from the electron gun 32 are incident on the surface **26*a* of the shadow mask 26** almost perpendicularly.

Figure 3B:
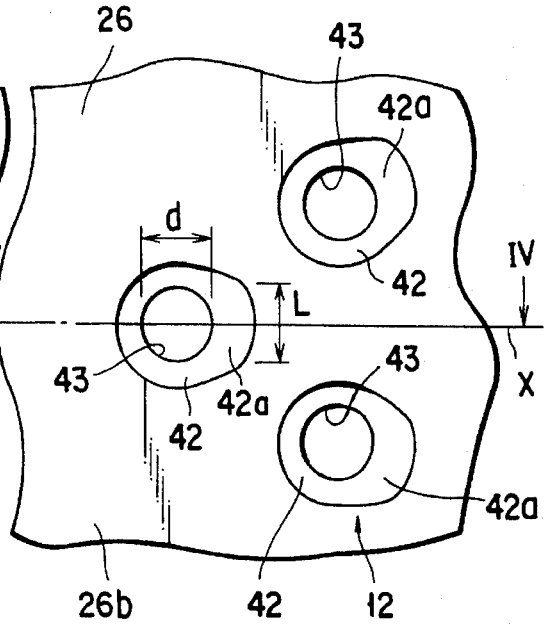
FIG. 3B is a plan view schematically showing the peripheral portion of the shadow mask enlarged.
Figure 4B:
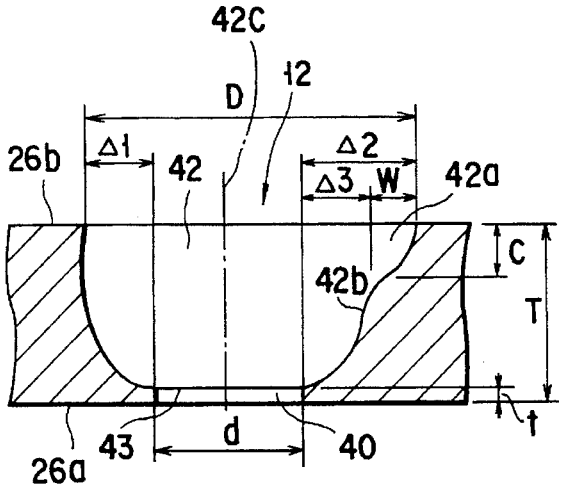

As shown in FIGS. 3B and 4B, in the peripheral portion of the shadow mask 26, the small and large openings 40 and 42 of each electron beam aperture 12 are formed also coaxially with each other. In the peripheral portion of the shadow mask 26, however, the electron beam are obliquely incident on the surface **26*a* of the shadow mask 26 and the electron beam apertures 12. In the peripheral portion of the shadow mask 26, therefore, the large opening 42 of each electron beam aperture 12 has an open shape which is not entire circular. A part of the large opening 42**, which is located at the radially outside of the center of the opening with respect to the mask center.

More specifically, the wall surface of the shadow mask 26 which defines the large opening 42 includes a bulged portion 42*a* which is bulged outward (right side of a center axis 42*c* of the large opening 42 in FIG. 4B) in a radial direction with respect to the mask center of the shadow mask 26 and which is located in opposite to the mask center of the shadow mask 26 with respect to the center axis 42*c* of the large opening 42. A width L of the bulged portion 42*a* in a direction of a tangential line relative to the open edge of the large opening 42, that is, a width in a direction perpendicular to the radial direction about the mask center, is made substantially equal to or slightly larger than a diameter of the electron beam aperture 12 or diameter d of its minimum-diameter portion 43. Further, the bulged portion 42*a* is formed in the wall surface of the shadow mask 26 which defines the large opening 42 of each electron beam aperture 12, extending from a shifting point 42*b*, which is located in the substantially middle of the wall surface in the axial direction of the large opening 42, to the open edge of the large opening 42.

A distance of the bulged portion 42*a* extending from the shifting point 42*b* to the open edge of the large opening 42 in the radial direction thereof, that is, an extent W to which the portion 42*a* is bulged, is larger as those electron beam apertures 12 which are arranged at the peripheral portion of the shadow mask 26 where the angle of the electron beam incident on them is large come nearer to the outer edge of the shadow mask 26. Similarly, a distance C extending from the shifting point 42*b* to the open edge of the large opening 42 in the axial direction thereof is made larger as the electron beam apertures 12 come nearer to the outer edge of the shadow mask 26.

In that region of the large opening 42 of each aperture 12 located at the peripheral portion of the shadow mask 26, which is located on the mask center side with respect to the center axis 42*c*, assume that the distance between the open edge of the minimum diameter portion 43 and that of the large opening 42 in the radial or horizontal direction is denoted by $\Delta 1$. Further, in that region of the large opening 42, which is located at the opposite side of the mask center with respect to the center axis 42*c*, assume that the distance between the open edge of the minimum diameter portion 43 and that of the large opening 42 in the radial or horizontal direction is denoted by $\Delta 2$ which is equal to ($\Delta 3$+W). Then, $\Delta 1$ and $\Delta 2$ represent inclination of these regions of the large opening 42. A dimension D of the large opening 42 at the open edge thereof is fundamentally denoted by ($\Delta 1+\Delta 2$+d). That portion of the large opening 42 which is represented by (D-W) is substantially circular opening and its center is located coaxial with that of the minimum-diameter portion 43. When the large opening defining wall surface along which the electron beam passes has $\Delta 2$ smaller than a value needed, it is bulged to form the bulged portion 42*a* so as to make $\Delta 2$ equal to the value needed.

When the opening pitch of the electron beam apertures 12 is 0.27 mm in the shadow mask used in the 14-inch color cathode ray tube and having a large radius of curvature, for example, thickness T of the shadow mask 26 is set 0.13 mm, large opening diameter D 0.205 mm, diameter d of the minimum-diameter portion 43 0.125 mm, height t from the surface 26*a* of the shadow mask 26 to the minimum-diameter portion 43 0.02 mm, bulged extent or amount W 0.035 mm, height c from the surface 26*b* of the shadow mask 26 to the shifting point 42*b* of the bulged portion 0.03 mm and width L of the bulged portion 42*a* *0.13* mm.

According to the above-described shadow mask 26, each of the electron beam apertures 12, which are located at the peripheral portion of the shadow mask 26 where the incident angle of the electron beam entering into shadow mask 26 is large, has the bulged portion 42*a* which is defined in the radially outward portion of the large opening 42, i.e., defined in that portion of the large opening 42 along which the electron beam passes and which is located outward in the radial direction with respect to the mask center of the shadow mask. Also at the peripheral portion of the shadow mask 26, 10 therefore, the electron beams emitted from the electron gun 32 and entering into each of the electron beam apertures 12 can pass through the minimum-diameter portion 43 and then reach the phosphor screen 24, without being shielded by the wall surface of the large opening 42 and the open edge thereof, to form an electron beam spot having a predetermined shape on the phosphor screen 24.

Further, the large and small openings 42 and 40 of each of the electron beam apertures 12 are made coaxial with each other. Therefore, the shape of the minimum-diameter portion 43 at which the large and small openings 42 and 40 are combined with each other can be not deformed but kept substantially circular. As the result, an electron beam spot having a desired shape can be formed on the phosphor screen 24.

Furthermore, the formation of the bulged portions 42*a* makes it possible to prevent electron beam omissions without making the dimension of each entire large opening 42 large. The amount of the shadow mask 26 etched from the side of the large opening 42 can be made smaller, thereby preventing the volume of the shadow mask 26 from being unnecessarily reduced. As compared with the conventional shadow masks, therefore, the mechanical strength of the shadow mask 26 can be kept higher, thereby preventing the tension strength of the mask from being lowered after it is press-formed.

As the result, even in the color cathode ray tube provided with a shadow mask, higher in definition, flatter and having a larger radius of curvature, brightness can be kept uniform both at the central and peripheral portions of the phosphor screen to thereby display an image more excellent in the uniformity of color purity. In addition, the tension strength of the mask can be kept higher after it is press-formed. This can prevent the shadow mask from being deformed by impacts applied while it is being manufactured and transported and after it is incorporated into the television set.

A method of manufacturing the above-described shadow mask will be described. A printing pattern used for forming the shadow mask will be described at first.

In the printing pattern, a large number of dot arrays each including a circular dot pattern are arranged in accordance with the aperture shape of the shadow mask 26 to be formed. Separate printing patterns are necessary for the large and small openings, and the designs of the printing patterns are different between the large and small openings.

Figure 5A:
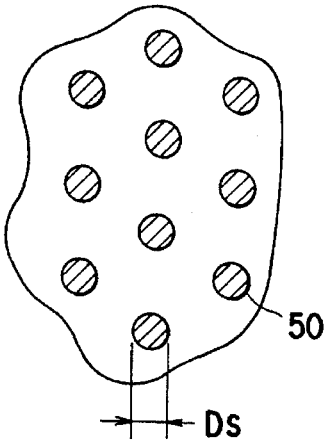

As shown in FIG. 5A, a small opening pattern is formed of opaque dot patterns 50, and the diameter Ds of the respective dots are substantially the same throughout the surface of the shadow mask. However, if shadow masks have different grades due to etching in spite of that the mask aperture diameters of the shadow mask specifications formed by etching are uniform, or if the shadow mask specifications specify masks having different grades, the dot diameter Ds of the small opening pattern must also be appropriately changed in accordance with the location on the shadow mask.

Figure 5B:
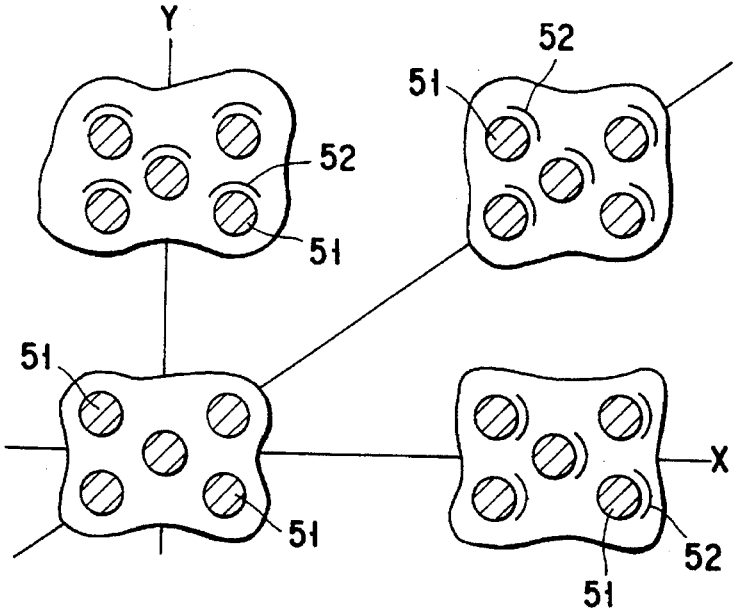
FIG. 5B is a plan view showing a resist film for large openings.

FIG. 5B schematically shows the state of the large opening pattern located at the central portion and the respective axial end portions of the shadow mask in the first quadrant of FIG. 2. In the central portion, the large opening pattern has a large number of opaque circular dot patterns 51 having a diameter larger than that of the small opening circular dot patterns 50. In the peripheral portion, the large opening pattern has a first pattern constituted by a large number of the circular dot patterns 51, and a second pattern constituted by a large number of arcuated independent patterns (sub-patterns) 52 for forming bulged portions on the side of the dot patterns 51, from which the electron beam propagates.

The center of each dot of the large opening circular dot pattern 51 substantially corresponds to the center of each dot of the small opening dot pattern 50. In a region extending from the mask center of the shadow mask to an arbitrary position, since the electron beam incident angle to the aperture 12 is small and the value of Δ2 necessary for not causing eclipse of the beam at the open edge of the large opening is small, the large openings are formed only of the opaque circular dot patterns having the same shape as that of the small openings.

The large opening pattern used for the peripheral portion of the shadow mask which is apart from the shadow mask center in the direction of the horizontal axis will be described with reference to FIGS. 6A through 6D.

When a dot diameter Dn of the large opening dot pattern 51 is changed, even if a pattern dot diameter Ds of the small openings is constant, the electron beam aperture size D (refer to FIG. 4B) obtained by etching changes. Accordingly, the dot diameter Dn of the large opening pattern is basically uniform throughout the shadow mask.

Figure 6A:
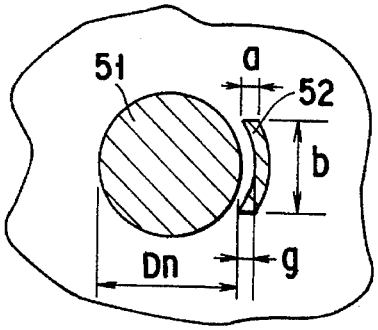
FIG. 6A is an enlarged plan view showing a large opening pattern having an arcuated sub-pattern.
Figure 6C:
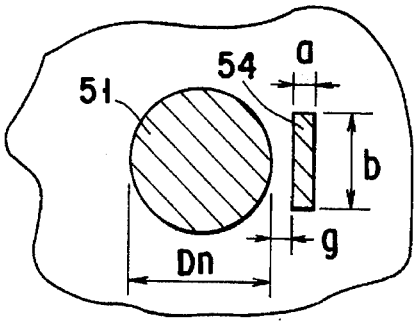
FIG. 6C is an enlarged plan view showing a large opening pattern having a linear sub-pattern.

As shown in FIG. 6A, the arcuated patterns 52 which are arranged independently of the large opening dot patterns 51 on the side of the respective dot patterns 51 in which the electron beam travels, i.e., on the radially outside of the respective dot patterns 51, are formed in those regions of the shadow mask which are remote from the mask center of the shadow mask by a certain distance. Regarding a width a of the arcuated pattern 52 in the radial direction, a length b of the arcuated pattern 52 in the circumferential direction, and a gap g between the arcuated pattern 52 and the dot pattern 51, in some case, they are set to be constant throughout the region in the shadow mask, in which the arcuated patterns 52 are formed, and in some case, they are gradually changed depending on the position of the shadow mask. It is asked that the length b of the arcuated pattern 52 in the circumferential direction is long enough to enable the electron beam passing through the bulged portion 42*a* to be completely passed through the shadow mask to the side of the phosphor screen and that it is designed to become equal to or slightly larger than the diameter d of the minimum-diameter portion. The second pattern is not limited to an arcuated pattern, but can be a linear pattern 54, as shown in FIG. 6C.

Figure 6B:
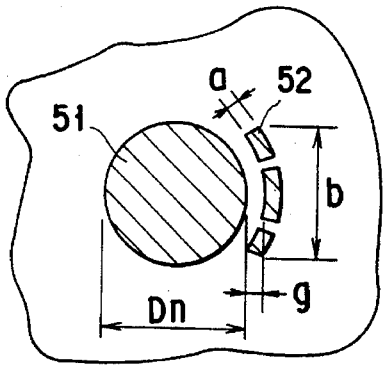
FIG. 6B is an enlarged plan view showing a large opening pattern having a divided arcuated sub-pattern.
Figure 6D:
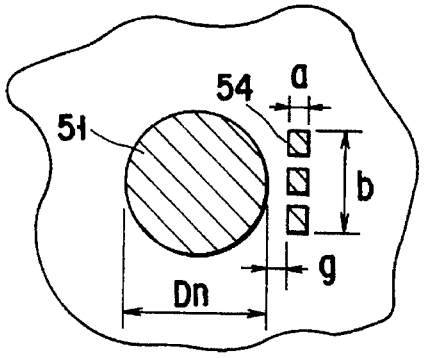
FIG. 6D is an enlarged plan view showing a large opening pattern having a divided linear sub-pattern.

In the etching process, the hatched portions in FIG. 6A are etched, and the resist film present between the dot pattern 51 and the arcuated pattern 52 tends to float. Depending on the types of the masks, the resist film at this position can be easily separated from the mask material by the impact of the sprayed etchant, and the separated resist film in the etchant can make the spray nozzle clog. In this case, as shown in FIG. 6B, the arcuated pattern 52 may be constituted by a divided arcuated pattern or as shown in FIG. 6D, the linear pattern 54 may be constituted by a divided linear pattern, both of which are separated with appropriate gaps. The gap of separation of the divided arcuated or linear pattern must be set within a range not influencing formation of a desired bulged portion. It is desirable that the gap is selected in a range of 10–30 μm.

If the gap g between the dot pattern 51 and the arcuated pattern 52 (or linear pattern 54) is excessively small, as side etching progresses in the etching process, the gap g can be joined to the large opening dot portion within a short period of time. Then, not only a necessary bulged portion is not formed, but also an aperture may be deformed. If the gap g is excessively large, the arcuated pattern 52 cannot be easily joined to the large opening dot pattern, and an aperture formed with a desired bulged portion cannot be obtained. Therefore, the gap g must be designed by considering the side etching amounts of the large opening dot pattern and the arcuated pattern and the etching amount of in the direction of depth of the joint portion formed after the large opening dot pattern and the arcuated pattern are joined.

The larger the width a of the arcuated pattern 52 or linear pattern 54 in the radial direction, the larger the side etching amount and the etching amount in the direction of depth. More specifically, if the width a is excessively large, the electron beam aperture can be easily deformed in a direction to form a bulged portion. Then, a desired bulged portion cannot be formed.

Since the mechanical strength of the shadow mask can be adjusted by suppressing the etching amount of the bulged portion in the direction of depth, it is preferable that the width a of the arcuated pattern 52 or linear pattern 54 in the radial direction is small. However, the width actually printed on the resist film depends on the coarseness of the surface of the mask material, the resolution of the resist film, and the thickness of the resist film. Therefore, when casein and bichromate ammonium, which are generally used as the resist material, are used, the width a is preferably selected in range of 10 to 30 μm.

Formation of the mask printing pattern described above is performed in accordance with automatic drawing by using a photoplotter. First, a high-resolution glass photographic plate is fixed on the plotter by suction with its emulsion surface facing upward. Pattern drawing data recorded as magnetic recording data is transmitted to the plotter through a computer, and light is radiated on the emulsion surface by the plotter in accordance with data, thereby forming a pattern latent image.

After drawing, the steps of development, washing with water, stop, fixing, washing with water, and drying are sequentially performed to form the desired mask printing pattern. In practice, a working pattern used in the shadow mask manufacturing process is not the pattern itself which is drawn by the photoplotter, but 10 a following pattern is used. The drawn pattern is reversed and brought into tight contact with a glass photographic plate to form a reverse image. Defects and the like of this reverse image are corrected, thereby forming a master pattern. A pattern formed by reversing the master pattern again and bringing it into tight contact with a glass photographic plate is used as the working pattern. When the master pattern is prepared, a necessary number of working patterns can be easily formed by reversing and bringing the master pattern into tight contact with a glass photographic plate by a number of times corresponding to the necessary number of the working patterns. The arcuated pattern for the large openings may be formed by using drawing means that forms an arc in accordance with linear interpolation.

In a printing pattern for manufacturing a shadow mask which is used in a 14-inch color cathode ray tube and has a large radius of curvature, a thickness T of 0.13 mm, and an electron beam aperture pitch of 0.27 mm, for example, the small opening dot pattern diameter Ds is 0.09 mm, the large opening dot pattern diameter Dn 0.105 mm, the gap g between the dot pattern and the arcuated pattern 0.02 mm, the width a of the arcuated pattern in the radial direction 0.02 mm and the length b of the arcuated pattern in the circumferential direction 0.075 mm.

A method of manufacturing the shadow mask by using the above-mentioned pattern will be described.

A shadow mask material having a predetermined thickness is decreased and cleaned by alkali solution and its both surface are then coated with a photo-resist film having a predetermined thickness, and dried. Printing patterns prepared as described above to form the small and large openings are brought into tight contact with the resist films coated on both surfaces of the mask material, and latent images of the patterns are formed in the resist films by using the ultraviolet rays.

Hot water of about 40° C. is sprayed to each resist film on which the predetermined pattern is formed in the above manner, thereby dissolving and removing the non-exposed portion of the resist film. Thus, those portions of the mask material at which electron beam apertures to be formed are exposed outside. After developing the resist films, each of the resist films is annealed at a temperature of about 200° C. in order to increase its etching resistance.

The process then advances to an etching step. If the mask material contains iron as the major component, a high temperature solution of ferric chloride is sprayed to the mask. In a high resolution shadow mask having small electron beam aperture pitch and size, etching is performed in two-step manner, for example. Various kinds of two-step etching have been proposed and an example of them will be described below.

Figure 7A:
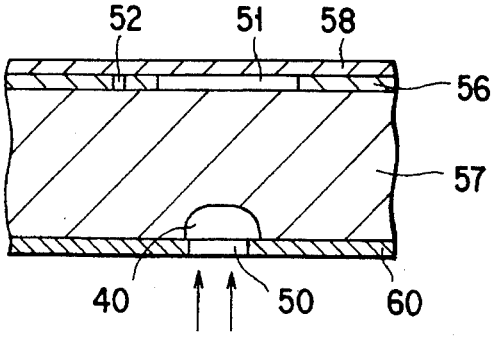

As shown in FIG. 7A, a protection film 58 is bonded to a resist film 56 formed on the large opening side surface of a mask material 57. Etching solution is then sprayed to the small opening side surface of the mask material through the circular dot pattern 50 of a resist film 60 formed on the small opening side surface, and this etching is performed until the small opening 40 having a desired size is formed. In this state, the large opening side of the mask material is covered with the protection film 58 so that it will not be etched. The mask material 57 is then washed by water and the resist film 60 and the protection film 58 are peeled off from the small and large opening sides of the mask material. The mask material 57 is again washed by water and dried.

Figure 7B:
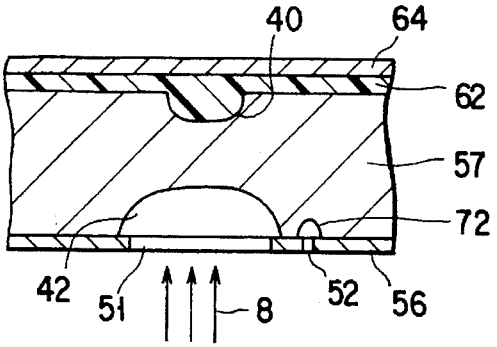

As shown in FIG. 7B, varnish which serves as an anti-etching material 62 is applied to the small opening side surface of the mask material 57 while filling the small opening 40 formed in the surface by etching, and a protection film 64 is then bonded to it. In this state, the small opening side surface of the mask material 57 is protected by the anti-etching material 62 and the protection film 64. No etching, therefore, progresses in the small opening side surface.

Figure 7C:
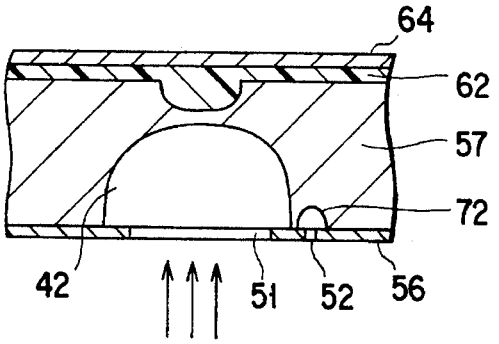

A second step etching is then applied to the large opening side surface of the mask material 57. At this step, the etching solution or etchant is sprayed to the large opening side surface of the mask material 57 through the circular dot patterns 51 patterned in the resist film 56 on the large opening side and also through the arcuated patterns 52 patterned in adjacent to the respective patterns 51. Etching of the large opening 42 and a bulged portion forming area 72 thus advances, corresponding to the circular dot pattern 51 and the arcuated pattern 52, respectively. The etching advances in the depthwise and lateral (side etching) directions without joining the large opening 42 and the bulged portion forming area 72 to each other, as shown in FIG. 7C.

Figure 7D:
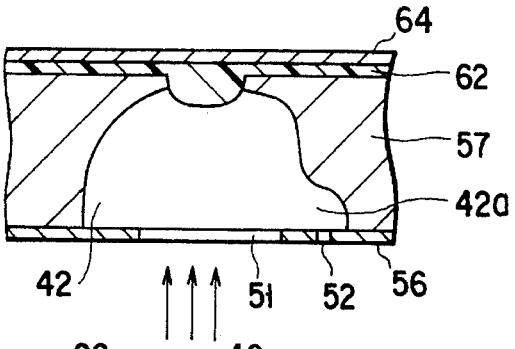
Figure 7E:
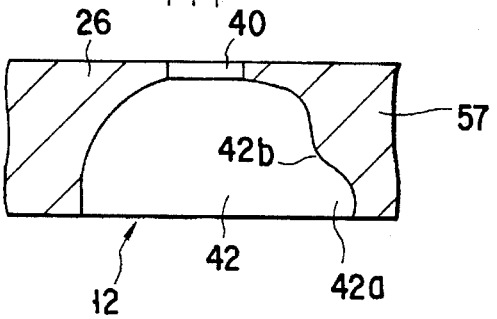

When the etching further progresses, the large opening 42 and the bulged portion forming area 72 are joined to each other by advancing side etching, as shown in FIG. 7D. By this joining, the bulged portion **42*a* is formed, having the shifting point 42*b* on the large opening wall surface of the mask material 57. The small and large openings 40 and 42 are also joined to each other by etching advancing in the depthwise direction. When the large opening 42** comes to have an intended size or sectional shape, the etching is finished.

The anti-etching material 62 and the protection film 64 are then removed from the small opening side surface of the mask material 57 while removing the resist film 56 from the large opening side surface thereof. The shadow mask 26 provided with intended electron beam apertures 12 is thus manufactured, as shown in FIG, 7E, and the second step etching relative to the mask material is now completed.

According to the second step etching, the smaller the width a of the arcuated pattern 52 in the radial direction, the pattern being patterned on the large opening side surface of the mask material, the lower the speed of etching in the lateral and depthwise directions. In addition, the larger the gap g between the large opening dot pattern and the arcuated pattern, the lower the speed at which the large opening and its corresponding arcuated pattern area are joined to each other. As the result, the bulged portion **42*a*** has a larger width but a smaller depth.

The larger the height c extending from the open edge of the large opening 42 to the shifting point **42*b* of the bulged portion 42*a*, the smaller the remaining volume of the shadow mask. It is therefore desirable that the height c is made smaller than ⅓ of the mask material thickness T. The shape of the bulged portion 42*a* provided with the shifting point 42*b*** depends upon pattern designing and it is also influenced by etching conditions such as temperature and density of etchant and spraying pressure. It is therefore desirable that final mask pattern designing is confirmed by results obtained from the practical shadow mask manufacturing line.

According to the above-described shadow mask manufacturing method, the size of the small opening that substantially determines the size of the electron beam aperture is determined and fixed in the first step etching. Thus, a variation in aperture size is muck smaller as compared with a scheme wherein the mask material is etched from the both surface and an etchant is blown through the communicating portion after the large and small openings communicate with each other as well. Thus, the method of this embodiment is suitable for the manufacture of a high definition shadow mask.

Figure 8:
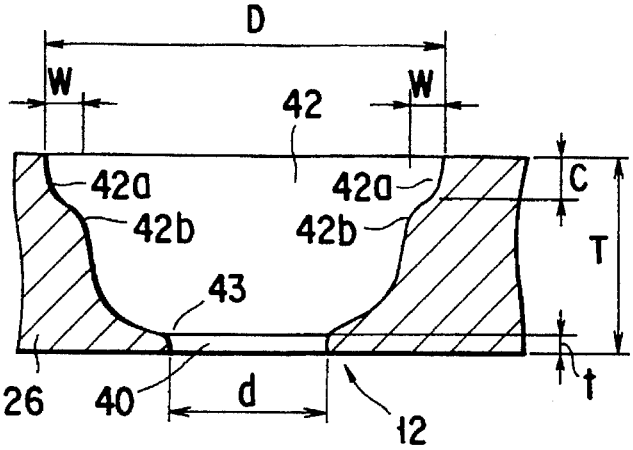
Figure 9:
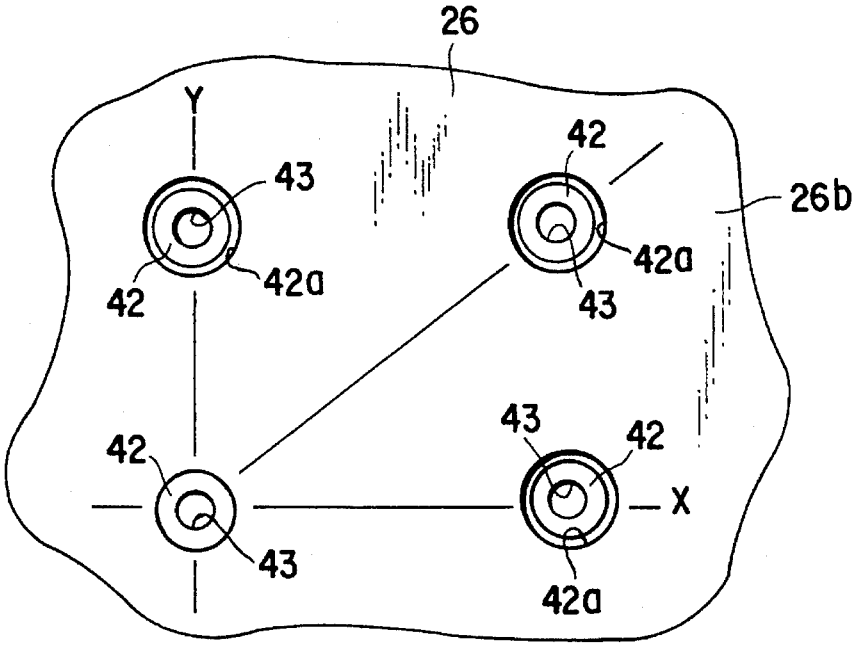

Although the bulged portion **42*a* has been formed, in the above-described embodiment, at that portion (radially outward portion) of the large opening defining wall surface of the shadow mask which is located outward in the radial direction with respect to the mask center of the shadow mask, a ring-shaped or annular bulged portion 42*a* may be formed along the entire open edge of the large opening 42, as shown in FIGS. 8 and 9. Specifically, that portion of the wall surface of the shadow mask 26, defining the large opening 42 of each of the electron beam apertures 12 at the peripheral portion of the shadow mask, which is adjacent to the open edge of the large opening and extends along the entire open edge, is bulged radially outward over to thereby defining an annular bulged portion 42*a*. Each of the electron beam apertures 12** thus formed is symmetrical in section with respect to its center axis.

The shadow mask 26 having those electron beam apertures 12 which are formed as described above can prevent omissions of electron beams passing through the electron beam apertures, as seen in the above-described embodiment. Further, only that portion of the wall surface which is adjacent to the open edge of the large opening is made larger in diameter. As compared with a case where the entire wall surface which defines the large opening is made larger in diameter, the volume of the shadow mask 26 can be less reduced and its mechanical strength can be more increased accordingly.

Figure 10:
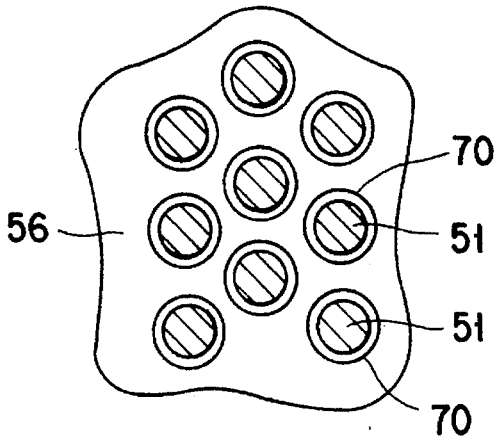
Figure 11A:
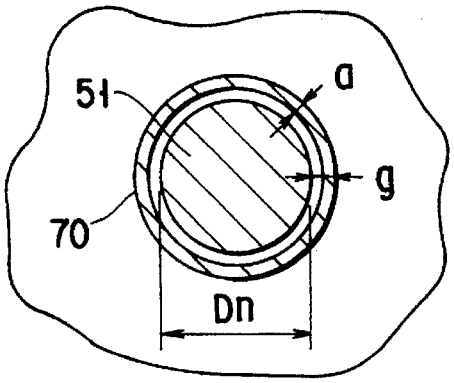
FIG. 11A is an enlarged plan view showing a large opening pattern having a ring-shaped sub-pattern.

When the large opening having the above arrangement is formed by etching, each large opening pattern formed in the resist film 56 has a first pattern constituted by a large number of circular dot patterns 51 and a second pattern constituted by a large number of annular patterns 70 formed around the respective circular dot patterns 51 to be coaxial with them, as shown in FIGS. 10 and 11A. The width a of the annular pattern 70 and the gap g between the annular pattern 70 and the circular dot pattern 51 are set as described above. When a resist film having this arrangement and the etching scheme described above are used, an electron beam aperture 12 shown in FIG. 8 is formed.

Figure 11B:
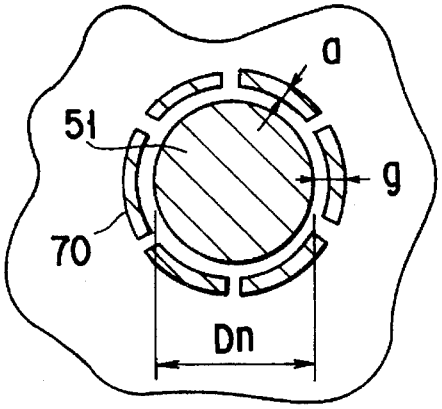

The annular pattern 70 may be divided into a predetermined number, as shown in FIG. 11B.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color cathode ray tube comprising:

a face panel having a phosphor screen formed on an inner surface thereof;

an electron gun arranged to oppose the phosphor screen, for emitting electron beams toward the phosphor screen; and a shadow mask arranged between the electron gun and the face panel to oppose the phosphor screen and having a large number of electron beam apertures which are formed almost all over the shadow mask and through which the electron beams pass;

the shadow mask including a first surface opposed to the electron gun, a second surface opposed to the phosphor screen, and a mask center aligned with a tube axis of the cathode ray tube, each of the electron beam apertures having a small opening open to the first surface of the shadow mask and a large opening open to the second surface of the shadow mask and communicating with the small opening, the large opening having a center axis and a diameter larger than that of the small opening, and wherein a wall surface of the shadow mask which defines the large opening of each of the electron beam apertures located at a peripheral portion of the shadow mask includes a bulged portion which is located on the opposite side of the mask center with respect to the center axis of the large opening and which is bulged outward in the radial direction.

2. A color cathode ray tube according to claim 1, wherein the bulged portion extends from an intermediate portion on the large opening defining wall surface of the shadow mask to an open edge of the large opening located on the second surface side of the shadow mask, said intermediate portion being located between the joining portion of the large opening to the small opening and the open edge of the large opening.

3. A color cathode ray tube according to claim 2, wherein the bulged portion has a width, in a direction substantially perpendicular to the radial direction with respect to the mask center, substantially equal to or slightly larger than a diameter of the joining portion of the large opening to the small opening.

4. A color cathode ray tube according to claim 1, wherein the large opening except for the bulged portion is arranged coaxially with the small opening.

5. A color cathode ray tube comprising:

a face panel having a phosphor screen formed on an inner surface thereof;

an electron gun arranged to oppose the phosphor screen, for emitting electron beams toward the phosphor screen; and a shadow mask arranged between the face panel and the electron gun to oppose the phosphor screen and having a large number of electron beam apertures which are formed almost all over and through which the electron beams pass;

the shadow mask including a first surface opposed to the electron gun, a second surface opposed to the phosphor screen, and a mask center aligned with a tube axis of the cathode ray tube;

each of the electron beam aperture including a small opening open to the first surface of the shadow mask, and a large opening open to the second surface of the shadow mask and communicating with the small opening, the large opening having a center axis and a diameter larger than that of the small opening; and wherein a wall surface of the shadow mask which defines the large opening of each of the electron beam apertures located at a peripheral portion of the shadow mask includes an annular bulged portion extending from an intermediate portion to an open edge of the large opening located on the second surface side of the shadow mask and being bulged outward in a radial direction of the large opening, said intermediate portion being located between the joining portion of the large opening to the small opening and the open edge of the large opening on the second surface side of the shadow mask.

* * * * *